United States Patent [19]

Almasi et al.

[11] 4,353,292

[45] Oct. 12, 1982

[54] ASSEMBLY FOR STORING AND FACILITATING APPLICATION OF BREATHING DEVICES

[75] Inventors: Istvan Almasi; Ferenc Kassai; Attila Erdelyi, all of Budapest, Hungary

[73] Assignee: Banyaszati Aknamelyito Vallalat, Budapest, Hungary

[21] Appl. No.: 183,926

[22] Filed: Sep. 3, 1980

[51] Int. Cl.[3] ..... E21F 11/00

[52] U.S. Cl. ..... 98/50; 98/115 R; 128/202.13; 128/200.27; 169/64; 312/236; 312/319

[58] Field of Search ..... 98/36, 39, 40 R, 40 C, 98/40 V, 49, 50, 115 R; 169/19, 23, 54, 64, 91; 312/236, 253, 319; 128/200.27, 204.29, 205.25, 205.26, 206.27, 202.13

[56] References Cited

U.S. PATENT DOCUMENTS

| | | | |
|---|---|---|---|
| 2,299,793 | 10/1942 | Cannaday et al. | 128/205.25 X |
| 2,934,293 | 4/1960 | Boehme et al. | 128/204.29 X |
| 3,503,394 | 3/1970 | Holtz et al. | 128/146.4 |

FOREIGN PATENT DOCUMENTS

| | | |
|---|---|---|
| 845316 | 7/1952 | Fed. Rep. of Germany . |
| 1090099 | 9/1960 | Fed. Rep. of Germany . |
| 1988879 | 3/1968 | Fed. Rep. of Germany . |

*Primary Examiner*—Harold Joyce
*Attorney, Agent, or Firm*—Karl F. Ross

[57] ABSTRACT

An assembly installable at an underground mine site for storing breathing apparatuses and for facilitating access to and application of such apparatuses comprises a matrix of storage receptacles closable on a common side by respective spring-loaded hinged doors. An actuating mechanism is provided on an assembly frame for simultaneously releasing a multiplicity of latches locking the doors closed, the actuating mechanism being coupled to a valve for opening the same to permit the passage of air from a pressure source to a perforated tube mounted under a cylindrical roof on top of the compartment matrix. The roof has an opening for guiding a stream of air into a space in front of the storage assembly, thereby increasing the time available for a successful application of the breathing devices in a disaster involving the depletion of the atmospheric oxygen supply or the release of toxic fumes into the work area. An acoustic transducer and a light are provided at the assembly in part for signaling to endangered personnel the location of the storage unit.

11 Claims, 8 Drawing Figures

ASSEMBLY FOR STORING AND FACILITATING APPLICATION OF BREATHING DEVICES

FIELD OF THE INVENTION

Our present invention relates to a storage assembly for storing life-support devices at the site of their eventual utilization. More particularly, our present invention relates to an assembly installable at a work area in a mine for storing breathing devices, e.g. masks, and for facilitating the use of such devices by endangered personnel at the work area.

BACKGROUND OF THE INVENTION

Breathing devices for supplying oxygen to mine workers upon the occurrence of a catastrophic or incipiently disastrous event such as a cave-in releasing toxic gases or a fire depleting the atmospheric oxygen or filling the air with smoke particles are generally small light-weight masks detachably carried on a belt or a helmet. Such masks are capable of carrying only a severely limited oxygen supply and frequently are not sufficient for enabling escape from mines where exit passages are blocked or where poisonous fumes are extensive.

Breathing devices which have a sufficiently large store of oxygen are too heavy and bulky to permit their being constantly carried by mine workers or other personnel. These larger devices must then be temporarily stored, usually by the individual workers, at the mining site. A disadvantage of such a procedure lies in the fact that smoke and dust frequently become so dense as to block or at least seriously limit vision, thus inhibiting or preventing a timely application of the breathing devices. Such circumstances occasionally induce panic which only serves to increase the probability of casualty.

OBJECTS OF THE INVENTION

The main object of our present invention is to provide an assembly installable at a work site, e.g. a mine, for storing relatively large breathing apparatuses and for facilitating access to such apparatuses in the event of a disaster which contaminates the air at the work site.

A more particular object of our present invention is to provide such an assembly which increases the time available for successful application of the breathing devices.

Yet another object of our present invention is to provide such an assembly which facilitates the application of the breathing devices.

SUMMARY OF THE INVENTION

An assembly installable at a work area for storing breathing devices and for facilitating the application thereof by endangered personnel comprises, according to our present invention, a plurality of compartments arranged in rows on a frame, the compartments serving as receptacles for respective breathing devices. At least one spring-loaded door is provided for closing the compartments at a common side thereof, the door having a hook projecting inwardly in a closed state of the door. The hook is engageable with a pivotably mounted latch for cooperating therewith in maintaining the door is a closed state.

An actuator on the frame for opening the door includes a push rod engageable with the latch to pivot the same, the rod being shiftable via the action of a spring-loaded release member in turn movable upon the pivoting of a lever which cammingly engages the release member.

A signal generator is included on the frame for emitting a signal indicating to the endangered personnel the location of the storage assembly, while an air circulator on the frame furnishes a supply of oxygen to a portion of the work area at least or at latest upon a pivoting of the lever and an opening of the door. An activator is operatively connected to the signal generator and to the air circulator for actuating same at latest upon an opening of the door.

According to another feature of our present invention, the air circulator includes a perforated tube, a source of pressurized air and a valve inserted between the tube and the source for interconnecting same at latest upon an opening of the compartment door. A deflector is mounted on the frame above the receptacles for guiding air from the tube, also located above the receptacles, to a region of the work area in front of the assembly, i.e. on the same side of the assembly as the compartment door.

According to a particular feature of our present invention, the deflector is in the form of a vaulted roof on the frame having an opening facing the region of the work area in front of the assembly, the tube being mounted on the frame or on the compartments beneath the roof.

The air-escape control valve may either be electromagnetically operated via a power source and a switch or mechanically operated via an element connected to the actuator.

The signal generator may be a light or an electroacoustic transducer energizable by the power source via a switch.

A storage assembly according to our present invention is easy to construct and to install, a cabinet or module being anchorable to the stone walls of the mine. The elements of the compartments and the frame may be produced from raw materials such as wood, metal or plastic in a short time. Accessibility to the breathing apparatuses and the time available for successful application of the apparatuses are maximized.

BRIEF DESCRIPTION OF THE DRAWING

These and other features and advantages of our present invention will now be described in detail, reference being made to the accompanying drawing in which.

SPECIFIC DESCRIPTION

Figure 1:
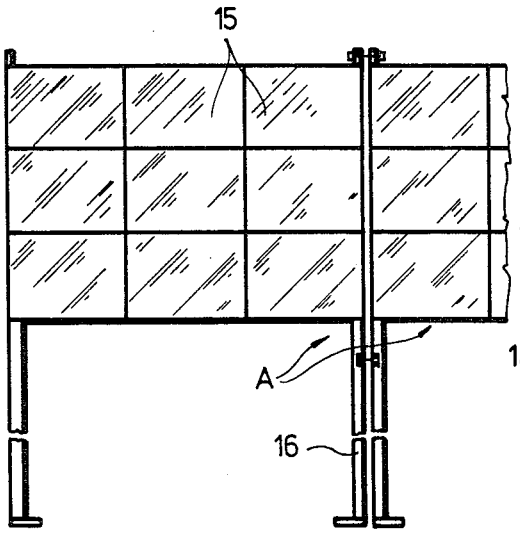
FIG. 1 is a front elevational view of a modular storage assembly according to our present invention, showing compartments with doors.
Figure 2:
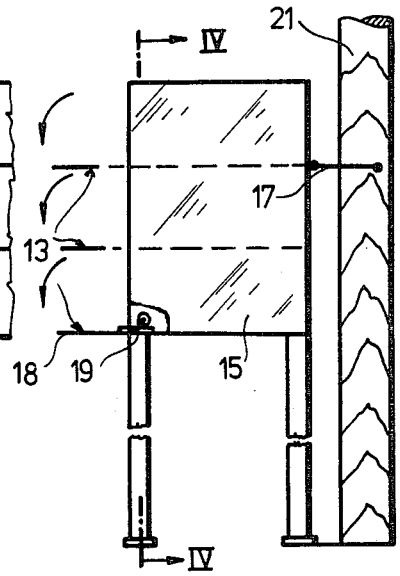
FIG. 2 is a side elevational view of the assembly of FIG. 1, showing open compartment doors.

As illustrated in FIGS. 1 and 2, an assembly installable in a work area such as a mine comprises, according to our present invention, a modular cabinet A including a plurality of modular compartments 15 serving as receptacles for respective life-support devices such as breathing masks (not shown). Compartments 15 are mounted in three rows of three compartments each on a frame 16 which may simply comprise several leg supports, the frame and the compartments being anchored to a wall 21 by means of bolts 17.

Compartments 15 are closable on a common side by respective doors 18 pivotably mounted on compartment walls and provided at hinged ends with tension springs 19 tending to rotate the doors into open positions (see FIG. 2). Doors 18 have at their free ends respective hooks or fingers 13 for coacting with latches 12 to hold the doors in closed positions, as described more fully hereinafter with respect to FIG. 4.

Figure 3:
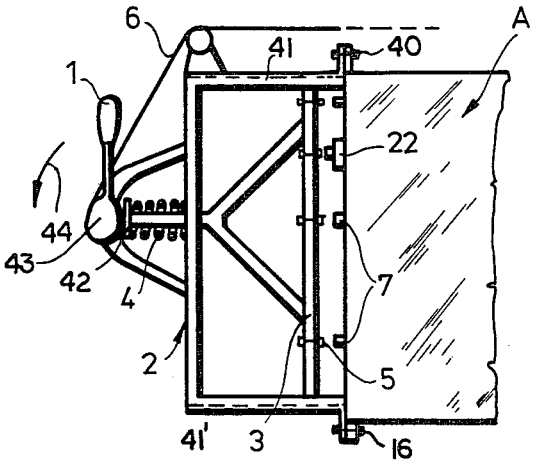
FIG. 3 is a front elevational view of an actuating mechanism, according to our present invention, for opening the doors of FIGS. 1 and 2.
Figure 7:
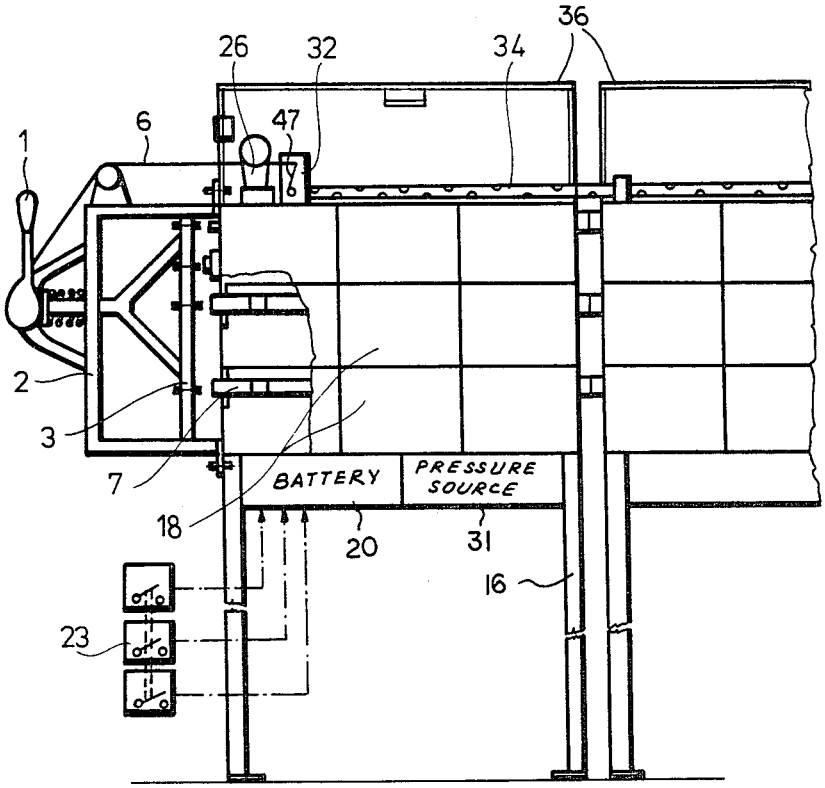
FIG. 7 is a front elevational view of the assembly of FIG. 1, additionally showing the actuating mechanism of FIG. 3 and the roof of FIGS. 5 and 6.

As illustrated in FIGS. 3 and 7, a mechanism for releasing latches 12 and thereby opening doors 18 includes a holder fastened by bolts 40 to frame 16 and including a pair of U-shaped arms 41, 41' serving as rails or tracks for a carriage 3. This carriage is biased towards the left in FIG. 3 by a restoring spring 4 maintained in compression between holder 2 and a flange 42 on carriage 3, flange 42 engaging the edge of a disk 43 rigid with an actuating lever 1 and eccentrically mounted on holder 2. Upon a pivoting of lever 1 in a direction indicated by an arrow 44, disk 43 cammingly coacts with flange 42 to shift carriage 3 to the right.

Figure 4:
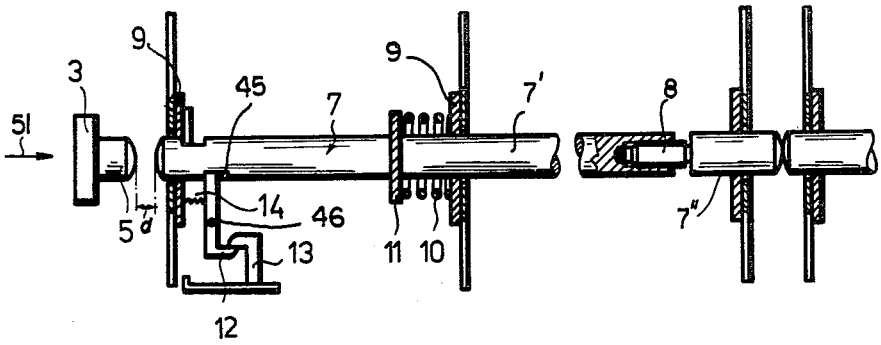
FIG. 4 is a partial cross-sectional view taken along line IV—IV in FIG. 2.

Carriage 3 is provided with a set of lugs projecting to the right in FIG. 3 for engaging push rods 7 and an actuating lever of a switch 22. As illustrated in FIG. 4, each push rod 7 traverses the three compartments 15 of a respective row of cabinet module A and is supported by lateral partitions of the compartments with the aid of bracing plates 9. A restoring spring 10 is compressed between one of the bracing plates and an annular disk or ring 11 rigid with the respective push rod 7 for returning the same to a withdrawn position.

Each push rod 7 includes a main portion 7' joined to an extension or secondary portion 7'' via a threaded bolt 8. This bolt may be screwed into and out of a bore in main shaft 7' for adjusting the width d of a gap between an outer end of the push rod and the free end of a corresponding lug 5 on carriage 3. Each push rod 7 is further provided with one or more recesses 45 into which an end of a respective latch 12 is inserted.

Each latch 12 is hingedly mounted on a compartment wall by means of a pivot 46 and is biased for motion in a counter-clockwise direction relative to the view of FIG. 4 by means of a restoring spring 14 anchored at one end to a compartment wall or reinforcing plate 9. Latch 12 lockingly engages a respective hook 13 on one of the compartment door 18.

Preferably, each row of compartments 15 is provided with a respective door 18, each door in turn being operatively associated with a respective push rod 7. It is also feasible, however, for each compartment to be provided with a separate door 18 and for each row of doors to be released via a common push rod. Another alternative is the provision of a single door for each modular cabinet A or bank of compartments.

Figure 5:
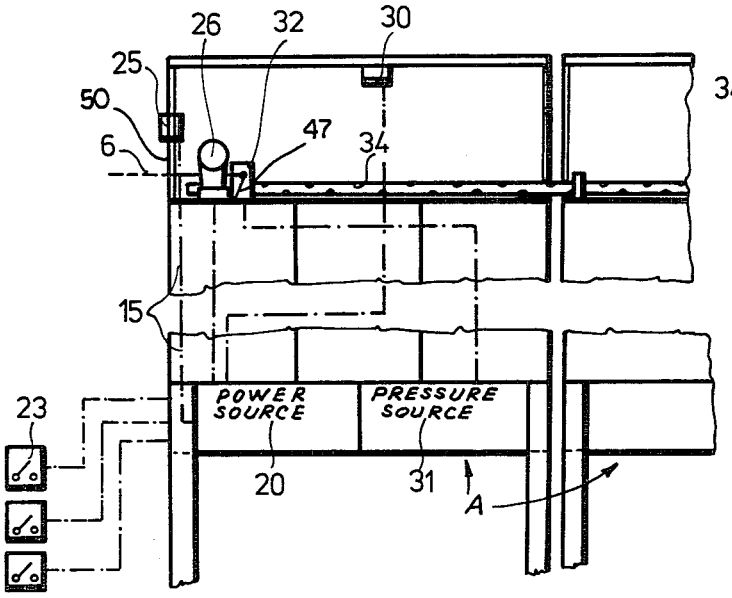
FIG. 5 is a front view of the assembly of FIG. 1, additionally showing a cylindrical roof.
Figure 6:
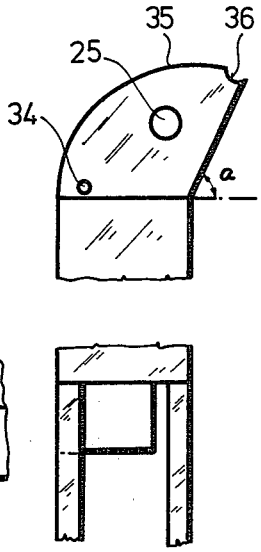
FIG. 6 is a side elevational view of the assembly shown in FIG. 5.

As illustrated in FIGS. 5 and 6, each modular cabinet or compartment bank A has a vaulted roof 35 mounted on the frame 16 in part for deflecting falling water and dirt. The roof or cover 35 has a substantially cylindrical upper surface projecting over the front side (the door side) of compartments 15 and provided at a forward edge with a channel or longitudinal recess 36 functioning as a gutter for preventing the dripping of water over the front roof edge. An opening having the shape of a rectangle in a plane inclined at an angle a with respect to the horizontal is formed between the upper row of compartments 15 and roof 35.

A blower 34 in the form of a perforated tube is mounted on the cabinet frame 16 or the upper compartment row at the rear of cover 35, as best seen in FIG. 6. Tube 34 is connectable to a source of pressurized air 31 via a valve 32. As shown in FIGS. 3, 5 and 7, valve 32 is preferably of the mechanically actuated type with a control lever or arm 47 connected via a tension cable or traction rope 6 to a moving component of the release mechanism, e.g. to lever 1, to disk 43 or to an axle (not shown) rotatably mounted in holder 3 and rigidly attached to disk 43 and lever 1.

Figure 8:
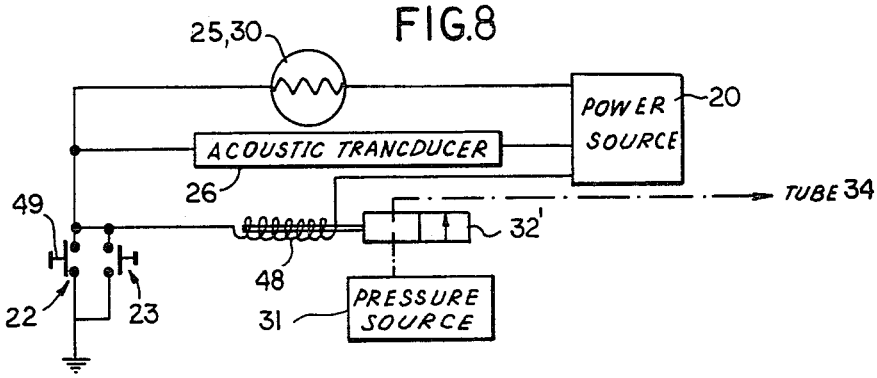
FIG. 8 is a diagram of a circuit for energizing signal generators shown in FIGS. 5–7.

As schematically illustrated in FIG. 8, tube 34 may be connectable to pressure source 31 via a valve 32' of the electromagnetic type having a coil 48 energizable by an electric-power source 20 upon the engagement of an actuating finger 49 of switch 22 by a corresponding lug on carriage 3 (see FIGS. 3 and 7).

As shown in FIGS. 5 and 6, each module A advantageously incorporates signal generators in the form of an electric-acoustic transducer 26 mounted on the top row of compartments 15 and a pair of lights 25 and 30 mounted in a side wall 50 and in the cylindrical top of roof 35, respectively. As indicated in FIG. 8, signal generators 25, 26 and 30 may be energized by power source 20 upon the actuation of switch 22 by the door-release assembly 1–5, 42, 43 (FIG. 3). Alternatively, the signal generators and valve 32' may be energized by closing a remote switch 23 connected in parallel to switch 22.

Pressure source 31 and power source 20 are advantageously in the forms of a high-pressure vessel and a storage battery secured to frame 16 but may also include respective remote supplies such as a compressor connected to a conduit network and an a-c current generator having a power-line distribution network. The storage battery and the pressure vessel may serve as back-up or replacement units tapped only upon the failure of the electric or compressed-air networks, respectively.

As illustrated in FIGS. 1, 4, 5 and 7, a plurality of modular compartment banks A may be juxtaposed to one another to increase storage capacity. The shaft extensions or auxiliary portions 7'' of push rods 7 may project beyond the respective lateral wall of the cabinet unit to engage the main shaft portion 7' of a push rod of an adjacent module A (see FIG. 4), whereby all the doors 18 in an assembly of modules may be opened upon the actuation of a single release mechanism 1–5, 42, 43. In such a juxtaposition of a plurality of compartment modules A the perforated tubes 34 thereof may be interconnected for receiving air from the same pressure source; likewise, the signal generators 25, 26 and 30 of the respective modules may be wired together for energization by the same power source upon actuation of a single switch 22 or 23.

Upon the occurrence of a catastrophic or incipiently disastrous event at a mining station, for example a fire depleting the air of oxygen and filling the work area with smoke or a cave-in releasing poisonous vapors, a workman at the site actuates switch 23, thereby energizing signal generators 25, 26 and 30 to alert other workmen to the location of the storage module A. As heretofore described, switches 22 and 23 are connected in parallel so that the signal generators may also be energized by the pivoting of lever 1.

Upon the actuation of either switch, valve 32 (or 32') is opened, thereby connecting tube 34 to pressure source 31. Air consequently ejected from the perforations of the tube is guided by roof 35 into the area in front of the storage cabinet A, whereby endangered personnel are provided with an oxygenated atmosphere during the time required for the extraction of breathing devices from receptacles or compartments 15 and the application or putting-on of these devices.

When tube 34 is connected to source 31 by means of mechanically operated valve 32, air is released from the source via the tube only upon the actuation of release mechanism 1–5, 42, 43 by a first workman to reach the storage cabinet A.

A pivoting lever 1 in the sense of arrow 44 (FIG. 3) results in a shifting of carriage 3 in the direction indicated by an arrow 51 in FIG. 4. The shifting of the carriage brings lugs 5 into engagement with push rods 7 which are subsequently moved in the same direction 51. Upon the shifting of push rods 7, latches 12 turn about their respective pivots 46 counter to the forces exerted by the respective restoring springs 14, whereby hooks 13 are released and doors 18 are swung into open positions under the action of pivoting springs 19 (see FIG. 2).

If switch 23 has not yet been actuated, the shifting of carriage 3 energizes signal generators 25, 26 and 30 via the activation of switch 22.

To increase the reliability of a storage assembly according to our present invention it is advantageous to provide for the charging of air ejectors 34 by both a compressed-air network and by pressure vessel 31, to provide for the energization of signal generators 25, 26 and 30 by both a power grid and battery 20 and to provide for both the mechanical and electrical actuation of the valve 32, 32' at tube 34.

It is clear that a storage facility according to our present invention enables endangered personnel to find their ways to the breathing devices even in a smoke filled work area. The supply of oxygen to the region in front of the storage module A introduces a safety factor by increasing the time workmen have to properly apply the breathing apparatuses. Such a time buffer decreases panic which might lead to fatal errors.

The storage facility is returned to an inactive mode by a reversal of the steps in the activation sequence. Lever 1 is returned to an upright position (see FIG. 3), thereby enabling the shifting of carriage 3 under the action of restoring spring 4 and the withdrawal or return of push rods 7 to waiting positions under the influence of springs 10. The disengagement or de-actuation of switches 22 and 23 de-energizes signal generators 25, 26 and 30 and closes electromagnetic valve 32'.

We claim:

1. An assembly installable in a work area for storing breathing devices and for facilitating the application thereof by personnel endangered by contaminated air at said work area, said assembly comprising:

a frame;

a plurality of compartments arranged in rows on said frame, said compartments serving as receptacles for respective breathing devices;

cover means including at least one spring-loaded door for closing said compartments at a common side thereof, said door having a hook projecting inwardly in a closed state of said door, said cover means including a pivotably mounted latch engageable with said hook for coacting therewith to close said door;

actuator means on said frame for opening said door, said actuator means including a push rod engageable with said latch to pivot same, a spring-loaded release member reciprocatably mounted on said frame and engageable with said rod to shift same, and a lever cammingly engaging said release member to move same upon a pivoting of said lever;

signal-generating means on said frame for emitting a signal indicating to said personnel the location of said assembly at said work area;

air-circulating means on said frame for furnishing a supply of oxygen to a portion of said work area upon a pivoting of said lever and an opening of said door; and activating means operatively connected to said signal-generating means and to said air-circulating means for actuating same at least upon an opening of said door.

2. The assembly defined in claim 1 wherein said air-circulating means includes a blower in the form of a perforated tube.

3. The assembly defined in claim 2 wherein said air-circulating means further includes a source of pressurized air and a valve inserted between said source and said tube for interconnecting same upon an opening of said door.

4. The assembly defined in claim 3, further comprising deflector means mounted on said frame for guiding air from said tube to a region of said work area in front of said compartments.

5. The assembly defined in claim 4 wherein said tube and said deflector means are mounted on said frame above said compartments.

6. The assembly defined in claim 5 wherein said deflector means is in the form of a vaulted roof on said frame having an opening facing the region of said work area in front of said compartments, said tube being mounted on said frame beneath said roof.

7. The assembly defined in claim 3, 4, 5 or 6 wherein said valve is an electromagnetically controlled valve, said activating means including a source of electric power connectable to said valve by a switch.

8. The assembly defined in claim 3, 4, 5 or 6 wherein said valve has an actuating arm, said activating means including an element connecting said arm to said actuator means.

9. The assembly defined in claim 1 wherein said signal-generating means includes a light.

10. The assembly defined in claim 9 wherein said signal-generating means further includes an acoustic transducer.

11. The assembly defined in claim 9 or 10 wherein said activating means includes a source of electric power connectable to said signal-generating means by a switch, said switch being mounted on said frame for operation by said actuator means.

* * * * *